United States Patent [19]

Walker

[11] Patent Number: 4,470,380

[45] Date of Patent: Sep. 11, 1984

[54] CHARGING AND DISTRIBUTING DEVICE FOR TWO-STROKE ENGINE

[76] Inventor: Roger B. Walker, Rua Paissandu 346, Rio de Janeiro, RJ, Brazil

[21] Appl. No.: 511,134

[22] PCT Filed: Dec. 3, 1982

[86] PCT No.: PCT/BR82/00020

§ 371 Date: Jun. 2, 1983

§ 102(e) Date: Jun. 2, 1983

[87] PCT Pub. No.: WO83/01985

PCT Pub. Date: Jun. 9, 1983

[30] Foreign Application Priority Data

Dec. 4, 1981 [BR] Brazil ..... 8107901

[51] Int. Cl.[3] ..... F04C 23/00; F02B 33/30; F02B 33/38

[52] U.S. Cl. ..... 123/65 BA; 123/65 B; 123/65 R

[58] Field of Search ..... 123/65 B, 65 BA, 65 R

[56] References Cited

U.S. PATENT DOCUMENTS

| | | | |
|---|---|---|---|
| 1,448,167 | 3/1923 | Sweet | 123/65 BA |
| 1,869,787 | 8/1932 | Trumble | 123/65 BA |
| 2,283,694 | 5/1942 | Perrine | 123/65 BA |
| 3,723,031 | 3/1973 | Brown | 418/15 |
| 4,137,018 | 1/1979 | Brucken | 417/440 |

FOREIGN PATENT DOCUMENTS

| | | | |
|---|---|---|---|
| 956279 | 1/1957 | Fed. Rep. of Germany | 123/65 BA |
| 1426541 | 12/1965 | France | 418/15 |
| 2400626 | 3/1979 | France | 418/15 |
| 319955 | 10/1929 | United Kingdom | 123/65 BA |
| 353852 | 8/1931 | United Kingdom | 123/65 BA |

*Primary Examiner*—Wendell E. Burns

*Attorney, Agent, or Firm*—Beveridge, DeGrandi & Kline

[57] ABSTRACT

There is described a charging and distributing device for a piston engine, the device including a variable displacement rotary compressor delivering through one of its shafts to a coaxial rotating distribution tube (1,25), the tube being formed with ports (4,29) which sequentially coincide with inlets (7,27) to the respective cylinders of the engine. A control system (14) to regulate the displacement of the compressor is disclosed, and the use of eccentrically weighted rotary pistons (10,12) and/or distribution tube to balance the engine as a whole is envisaged.

5 Claims, 5 Drawing Figures

CHARGING AND DISTRIBUTING DEVICE FOR TWO-STROKE ENGINE

The present invention relates to a charging and distrubuting device for two-stroke engine, and is particularly concerned with the use of a rotary piston compressor of the type which delivers the compressed working fluid through one of its shafts to feed air or an air/fuel mixture to the cylinders of a piston engine.

The use of positive displacement compressors for charging two-stroke engines is well known, and is a technique frequently used in connection with larger engines. The main types of compressors used have been: Roots blowers, oscillating vane compressors, and helicoidal screw compressors. There have also been various proposals for rotary sleeve valves to regulate the distribution of the charge to the cylinders.

The present invention provides a single device which will selectively deliver a compressed charge to a respective cylinder of an engine, and is capable of being controlled to regulate the amount of charge delivered. The present device has the advantages of being not only compact, simple and inexpensive, but also that of being easily controllable. The device is capable of reducing the pumping losses caused by throttling when the engine is running at low load.

The present device is also capable of serving as a balancing means to reduce engine vibration, by the incorporation of eccentric masses into its pistons, drive, or delivery apparatus.

The object of the invention is to provide a relatively simple and cheap alternative to crankcase charging in two-stroke engines, so as radically to improve scavenging and reduce pollution, to simplify crankcase construction and lubrication, and to reduce pumping losses by substituting a variable displacement compressor for the conventional control of the induced charge by throttling. Also engine balance may be improved by effectively incorporating a secondary balancing shaft in the engine as part of the charging device.

The present invention comprises a variable displacement rotary piston compressor of the type in which the compressed fluid leaves the compression chamber via one of the compressor shafts. This shaft is extended to form a rotating distributor tube, and is positioned so that it passes close to the cylinders of an engine. Axially spaced ports are formed in the wall of the distributor tube at locations corresponding to the cylinders, the ports being in intermittent fluid communication with the cylinders either directly or via short ducts.

The compressor is driven at engine speed, and thus each port opens and closes in the manner of a rotary sleeve valve to control entry of the charge to the cylinder. The system does not rely on the engine pistons to open and close the ports admitting charge to the cylinder, and thus the location of the inlet-port is not restricted to the lower cylinder wall but may even be in the cylinder head itself.

Clearly the pistons or distributor tube may be weighted to provide a mass balancing effect to the engine as a whole.

Two embodiments of the present invention will now be described with reference to the accompanying drawings, in which.

Figure 1:
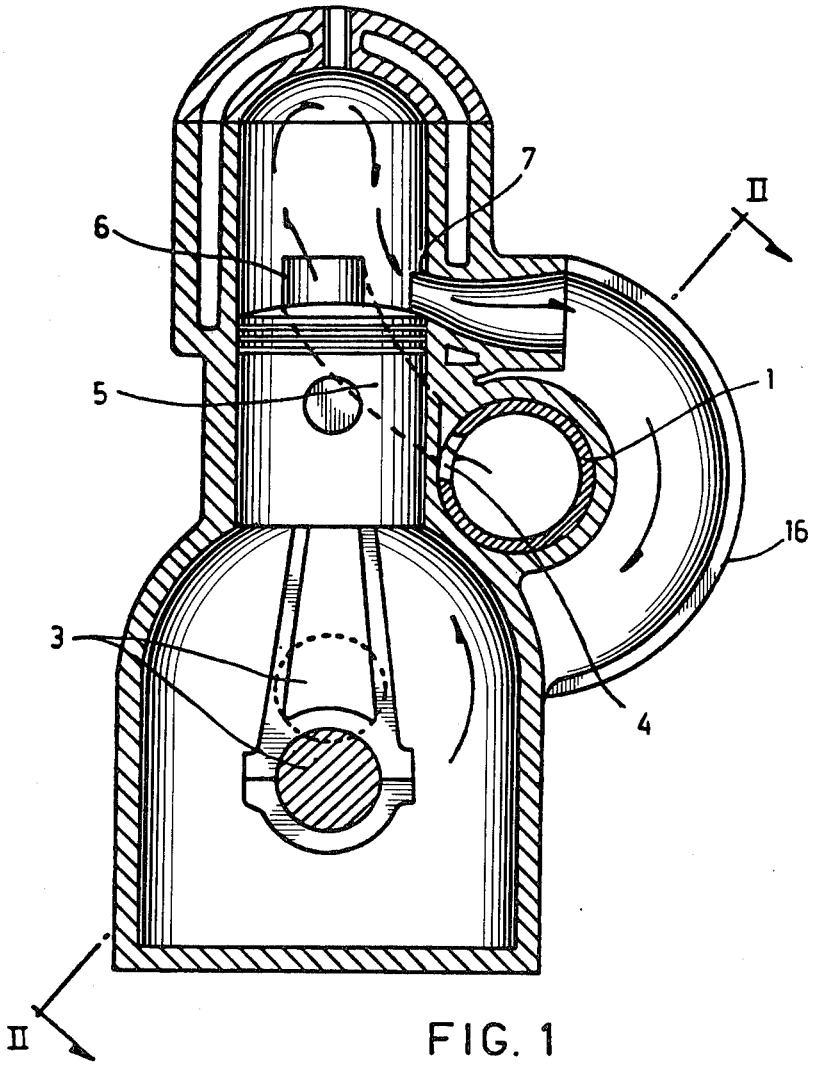
FIG. 1 is an end sectional view of an engine incorporating the present device, the section being taken on line I—I of FIG. 2.

Referring now to FIGS. 1 to 4, FIG. 1 shows how the compressed charge (or air in the case of an engine with direct fuel injection) is fed to the cylinders of an engine, each cylinder having inlet and exhaust ports in its cylinder wall. The compressed air or air/fuel mixture is conducted inside a distritutor tube 1 which rotates in the direction of arrow 2 at a velocity equal and opposite to that of crankshaft 3. A port 4 in the wall of the distributor tube 1 opens when its position coincides with the lower end of a transfer duct 5. The charge passes through the transfer duct 5 and transfer port 6 in the cylinder wall. The port 4 in the wall of the distributor tube is arranged to open before or after the cylinder exhaust port 7 according to the disered degree of supercharging, type of exhaust in the speed of the engine. Considerations of resonance in the transfer duct 5 also determine the precise dimensioning of the transfer ports 7 and time of the opening of the port 4 in the distributor tube 1.

Figure 2:
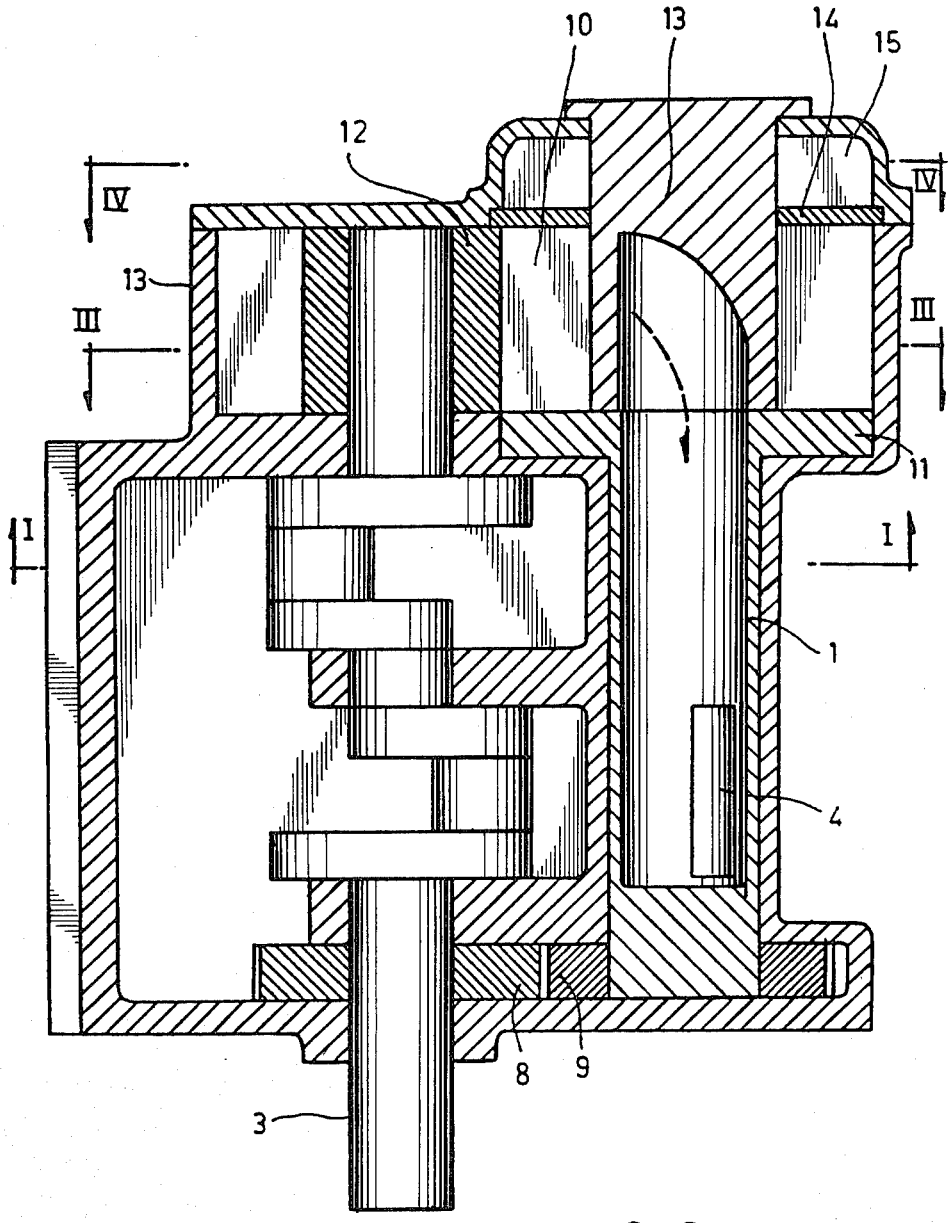
FIG. 2 is a sectional view taken on line II—II of FIG. 1.

FIG. 2 is a cross section, on line II—II, through the centers of the crankshaft 3 and the distributor tube 1. A gear 8 fixed to the crankshaft engages with an equal diameter gear 9 fixed to one end of the distributor tube 1. At the other end of the distributor tube main rotary piston 10 is mounted on flange 11. Gate rotary piston 12 is mounted on the crankshaft 3, and rotates therewith.

Main rotary piston 10 has a central cavity, in which is positioned valve 13. Abutting the rotary piston 10 in a regulating disc 14 whose angular position determines the volume of charge pumped by the compressor during each revolution. A device for adjusting the angular position of the disc (not shown) acts as an engine control. On the side of the regulating disc remote from piston 10 is a return to the compressor inlet.

By suitably locating balancing holes inside the gear 9 and flange 11 on the distributor tube 1, it can be made to function as a secondary balancing shaft for the whole engine.

Figure 3:
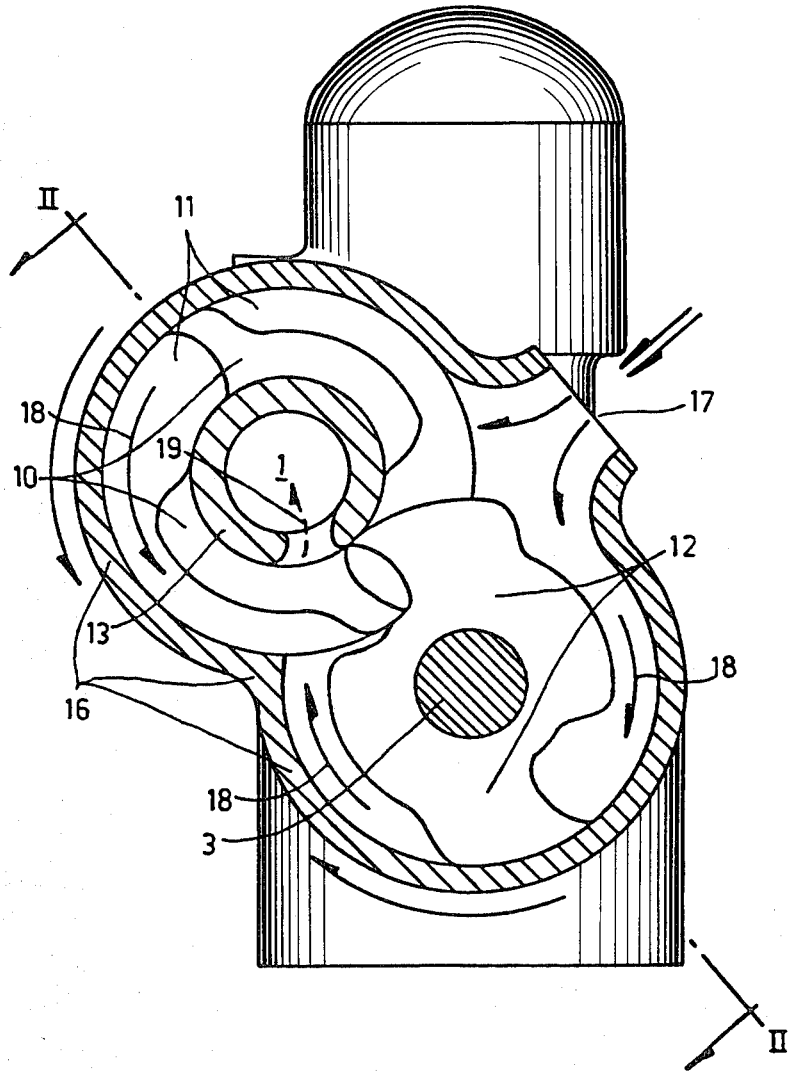
FIG. 3 is an end view showing the piston shapes of the rotary piston compressor.

In FIG. 3 is shown a cross-section through the rotary pistons of the compressor. The toothed main piston 10, which in this case comprises two elements attached to the flange 11, rotates in sealing proximity with the gate piston 12, and both rotate in sealing proximity with a casing 16. The main piston 10 rotates on the shaft provided by the distributor tube 1; the gate piston 12 on the crankshaft. A stationary sleeve valve 13 is located inside the hollow main piston 10, in sealing proximity therewith.

The charge is sucked into the compressor inlet 17, and flows in the direction of the arrows 18, and when compressed is delivered into the sleeve valve 13 and the distribution tube 1 in the direction shown by the arrow 19. A compressor such as the one illustrated may function with a fixed sleeve valve (as shown), a variable-area sleeve valve, a leaf valve or a combined sleeve valve and leaf valve. Compressors of this type are fully described in applicants copending application No. PCT/BR82/00015.

Figure 4:
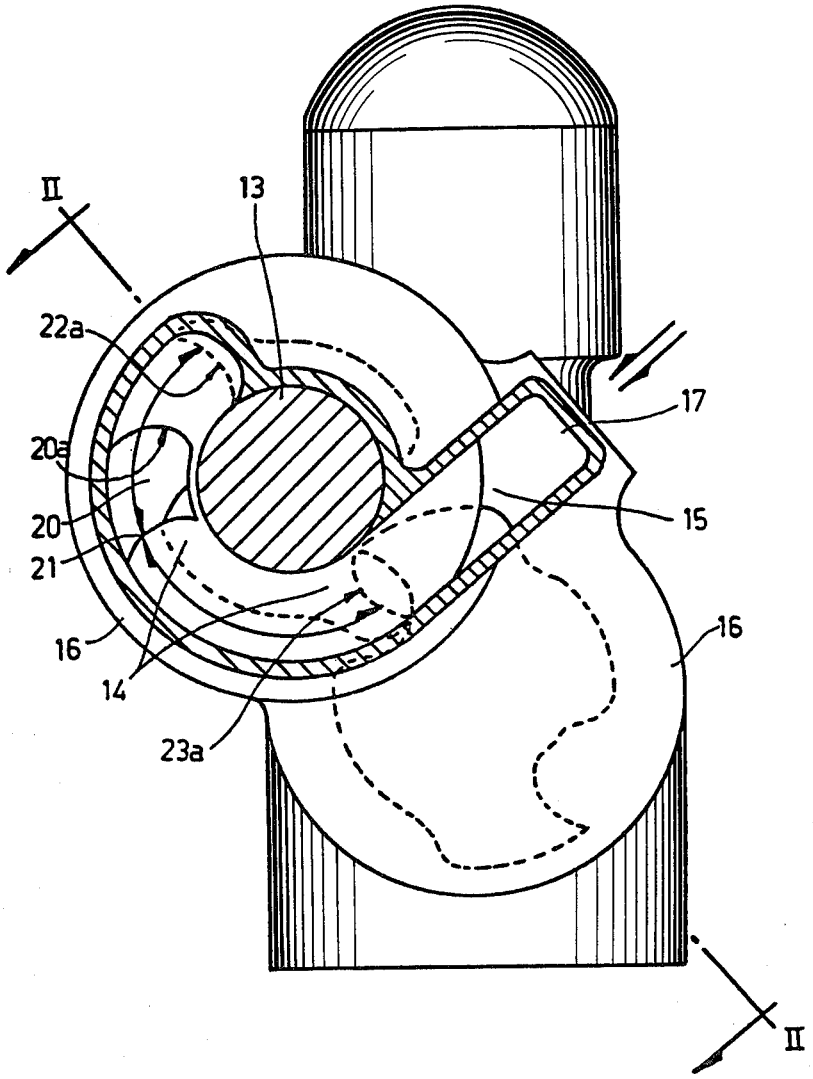
FIG. 4 is an end view similar to FIG. 3 showing the charge regulating device.

FIG. 4 shows a cross section (on the line IV/IV) through the return duct 15, which is part of the compressor casing 16, and which conducts the excess charge through the opening 20 in the regulating disc 14 back to the compressor inlet 17.

With the leading edge 20*a* of the opening in the regulating disc in the position shown 21 about 45% of the charge would be returned to the inlet, or "unloaded" via duct 15. With the leading edge 20*a* of the hole 20 in the disc in position 22*a* no charge would be unloaded, and the engine shown would then be about 50% supercharged. With the leading edge 20*a* of the hole in the disc in position 23*a* the compressor would be 100% unloaded and no charge would be delivered. The device for rotating the unloading disc is not shown, but could be any conventional device such as for example a worm drive or a Bowden cable.

Figure 5:
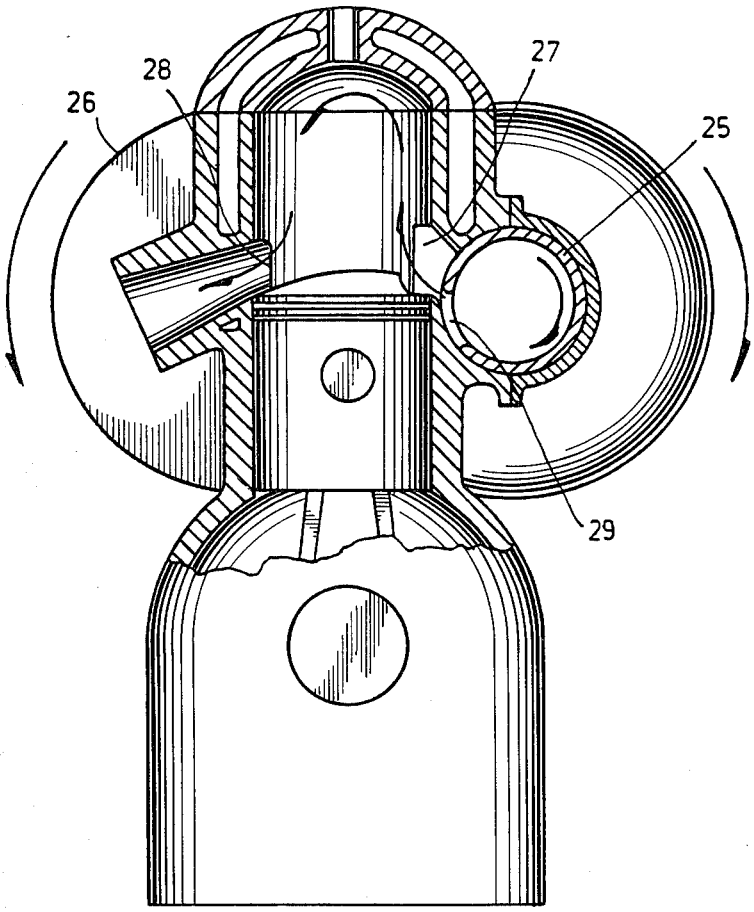
FIG. 5 is an alternative configuration of the device, in which the distributor tube ports open directly into the cylinders.

FIG. 5 illustrates an alternative incorporation of the charger in a two-stroke engine. In this case the distributor tube 25 is located adjacent the inlet ports in the cylinders, and the gate rotor of the compressor is not mounted on the end of the crankshaft, but on an independent shaft in a separate casing 26.

In this type of engine the inlet port 27 in the cylinder wall may be arranged to open before, or after the exhaust port 28; depending on the desired performance. Transfer ports 29 in the distributor tube may be so shaped or slotted as to direct the flow of the induced charge to desirable regions in the cylinders, especially away from the exhaust ports 28. The distributor tube 25 may also serve as a secondary balancing shaft. It is also possible that the gate rotor of the charging compressor by mounted on the crankshaft, as in the engine illustrated in FIGS. 1, 2, 3, and 4.

Clearly, other arrangements of the charger and distributor tube are possible. One such possibility is to mount the distributor tube in the cylinder heads on an in-line engine, with the distributor tube functioning as a sleeve valve. Alternatively, in a 90° vee-type engine, a general arrangement as illustrated in FIG. 7 may be used with a single distributor tube, but with transfer ducts leading off at different angles to each bank of pistons. Yet another alternative in a 90° vee-engine is to use two distributor tubes, each one located directly behind the transfer ports of the cylinders in a respective bank. Such an engine would either employ two separate charging compressors, or would employ a single charging compressor delivering the compressed charge inside both hollow rotary pistons, each being mounted on a distribution tube. Obviously, each compressor piston would have a number of teeth equal to the number of cylinders served by that compressor.

I claim:

1. A charging and distributing device for a piston engine, comprising a rotary piston compressor having toothed main and gate pistons mounted on respective parallel shafts, the main piston shaft being hollow and the compressor being arranged to deliver compressed fluid to the interior of the hollow shaft, characterized in that the hollow shaft (1,25) is extended to form a distribution tube, and the distribution tube is formed with a number of ports (4,29), each port being in intermittent fluid communication with a respective cylinder of the engine to admit fluid compressed by the compressor into the cylinder for subsequent compression therein.

2. A charging device according to claim 1, characterized in that the rotary piston compressor includes (14) means to regulate its displacement.

3. A device according to claim 2, characterized in that the regulating means comprises a rotatable disc (14) coaxial with and abutting the main rotor, an opening in the disc providing selective fluid communication between the working volume of compressor and a return duct (15).

4. A device according to any preceding claim characterized in that the distribution tube (1,25) or rotary pistons (10,12) serve as eccentric balancing means for the engine.

5. A device according to any one of claim 1 to 3 characterized in that the gate piston (12) is mounted on the crankshaft (3) of the engine for rotation therewith.

* * * * *